United States Patent [19]

Osborne, Gregory W. et al.

[11] 4,288,794

[45] Sep. 8, 1981

[54] SHIELDED LOOP VOR/ILS ANTENNA SYSTEM

[75] Inventors: Osborne, Gregory W.; William C. Ripley, both of Arlington; Robert E. Wilson, Fort Worth, all of Tex.

[73] Assignee: Textron Inc., Providence, R.I.

[21] Appl. No.: 106,285

[22] Filed: Dec. 26, 1979

[51] Int. Cl.[3] ..... H01Q 1/28; H01Q 7/04

[52] U.S. Cl. ..... 343/708; 343/742; 343/744; 343/842

[58] Field of Search ..... 343/705, 708, 741, 742, 343/842, 866, 867, 744

[56] References Cited

U.S. PATENT DOCUMENTS

| | | | |
|---|---|---|---|
| 1,826,843 | 10/1931 | Thomas | 343/869 |
| 2,159,379 | 5/1939 | Hyland | 343/705 |
| 2,202,368 | 5/1940 | Berndt | 343/842 |
| 2,270,224 | 1/1942 | Spangenberg | 343/708 |
| 2,301,418 | 11/1942 | Lear et al. | 343/842 |
| 2,328,024 | 8/1943 | Limb | 343/867 |
| 2,349,154 | 5/1944 | Finch et al. | 343/842 |
| 2,376,393 | 5/1945 | Sheridan | 343/708 |
| 2,419,480 | 4/1947 | Bryan et al. | 343/842 |
| 2,485,654 | 10/1949 | Pickles | 343/842 |
| 2,959,782 | 11/1960 | Carter | 343/708 |
| 2,996,610 | 8/1961 | Relis | 343/842 |
| 3,373,430 | 3/1968 | Croswell et al. | 343/708 |
| 3,475,755 | 10/1969 | Bassen et al. | 343/705 |
| 3,588,905 | 6/1971 | Dunlavy | 343/856 |
| 3,680,127 | 7/1972 | Richard | 343/708 |
| 3,902,177 | 8/1975 | Mori et al. | 343/741 |
| 3,973,263 | 8/1976 | Green | 343/842 |

FOREIGN PATENT DOCUMENTS 2363405 2/1972 France .

*Primary Examiner*—Eli Lieberman

*Attorney, Agent, or Firm*—Richards, Harris & Medlock

[57] ABSTRACT

A VOR/ILS antenna system for rotor aircraft eliminates rotor modulation of signals without varying rotor speed. The system comprises one or more loop antennas each having one or more closed loop windings mounted on the aircraft in a generally horizontal plane and having a conductive shield covering the windings and dielectrically separated therefrom and having a small gap breaking the continuity thereof. A dual loop VOR/ILS system for helicopters is particularly disclosed wherein the pair of loop antennas are mounted in a horizontal plane on opposite sides of the central vertical helicopter mast extending upwardly between a pair of cowling members in which the antennas are disposed. Each antenna has a gap in the shield facing inboard and a connection point for the windings opposite the gap and outboard. The connection point provides a lobe in the individual radiation pattern of the respective loop antenna which is outboard relative to the mast and which compensates an otherwise null point in the composite radiation pattern of the pair of loop antennas whereby to provide an omnidirectional composite radiation pattern. The helicopter itself further compensates the otherwise null point to provide in combination with the dual loop antenna system a substantially circular radiation pattern. Antenna construction is also disclosed.

21 Claims, 11 Drawing Figures

SHIELDED LOOP VOR/ILS ANTENNA SYSTEM

TECHNICAL FIELD

The present invention relates to a VOR/ILS (Very High Frequency Omni Range/Instrument Landing System) antenna to enable certification for IFR (Instrument Flight Rules) of aircraft previously certified only for VFR (Visual Flight Rules) or capable of using IFR only upon changing rotor RPM. The invention further relates to a particular antenna construction.

BACKGROUND

In rotor aircraft, such as helicopters and prop planes, rotor modulation of received radio signals has been a continuing problem in the VOR/ILS frequency range, commonly 108–118 megahertz. In order to be certified for IFR, the aircraft must have an antenna system which has an omnidirectional radiation pattern and can receive the instrument landing information over the transmitted frequency without being garbled by rotor modulation or coupling. Prop planes have employed a dipole antenna bent in a V-shape to provide an omnidirectional radiation pattern, and have changed the RPM of the rotor in order to eliminate modulation when receiving instrument landing information. Helicopters have a much smaller permissible RPM window (commonly around 4%) and thus cannot change rotor RPM enough to eliminate rotor modulation, and hence have not been certified for IFR.

SUMMARY OF THE INVENTION

The present invention provides a VOR/ILS antenna system for rotor aircraft, such as helicopters and prop planes, which eliminates rotor modulation of signals without varying rotor speed. A loop antenna has one or more closed loop windings mounted in a generally horizontal plane and has a conductive shield covering the windings in close proximity thereto and dielectrically separated therefrom such that the impedance of the loop antenna is not affected by rotor modulation. The shield has a small gap breaking the continuity thereof. It has been found that a single antenna may be employed if mounted at a position for receiving VOR/ILS signals without interposition of the aircraft between the antenna and the VOR/ILS signal source.

In another aspect of the invention, a pair of loop antennas, each having one or more closed loop windings, are mounted and spaced on the aircraft in a generally horizontal plane. Each antenna has a conductive shield covering the windings. Each shield has a small gap breaking the continuity thereof and facing inboard opposite the gap in the other shield. Each antenna has a pair of electrical leads extending through the respective shield from the windings at an outboard connection point opposite the gaps. This antenna pair system is not subject to the positioning constraints of a single antenna because the composite radiation pattern of the pair is omnidirectional. Each loop is intentionally made non-ideal with opposite outboard lobes in the individual radiation patterns caused by the respective connection points of the electrical leads. These lobes compensate an otherwise null point in the composite radiation pattern of the pair. The pair in combination further provides amplification of the signal.

In a further aspect of the invention, a helicopter VOR/ILS antenna system is provided for a helicopter having a longitudinal body with a vertical mast extending upwardly therefrom and supporting a rotor blade having a horizontal rotary plane of motion. A pair of loop antennas, each having one or more closed loop windings, are mounted on the helicopter in a generally horizontal plane and laterally spaced on opposite sides of the longitudinal center line of the helicopter body. Each antenna has a conductive shield covering the windings and dielectrically separated therefrom. Each shield has a small gap breaking the continuity thereof and facing the gap in the other shield. Each antenna has a pair of electrical leads extending through the shield from the windings at a connection point opposite the gap. Each connection point provides a lobe in the individual radiation pattern of the respective loop antenna which is outboard relative to the center line of the helicopter and which compensates an otherwise null point in the composite radiation pattern of the pair of antennas, whereby to provide an omnidirectional composite radiation pattern. This otherwise null point is further compensated by the helicopter itself such that the antenna system in combination with the helicopter provides a substantially circular radiation pattern.

In the preferred form of the helicopter dual antenna system, the invention enables advantageous use of existing cowling for antenna positioning purposes. In many types of helicopters, the most advantageous place to mount an antenna is within the cowling because of ease of access thereto (as such cowlings are commonly detachable) and because such cowlings are usually made of material which is optically transparent at VOR/ILS frequency. There are usually a pair of cowling members attached to the upper helicopter body covering transmission gearing and the like, and between which extends the mast vertically upwardly. These cowling members are typically each a one-piece integral unit having an outer shroud portion with an air intake port and an inner air-guide tube portion extending from the intake port. There is a horizontal void space between the underside of a top wall of the shroud portion and the air-guide tube portion which is separated from the complementary void space in the other cowling member by slightly over four feet, which is approximately $\frac{1}{2}$ wavelength of VOR/ILS signal frequency. The present invention takes advantage of this coincidental desirable length by enabling mounting of the pair of antennas at the noted spaces, and still maintain an omnidirectional radiation pattern, notwithstanding interposition of the helicopter body between the antenna and the VOR/ILS signal source due to mounting the antennas on top of the helicopter.

A particularly advantageous loop antenna construction employs a dielectric frame having a groove around its perimeter, one or more closed loop windings situate in the groove, and a conductive shield covering this dielectric frame. The frame is preferably a laminated structure of dielectric material comprising a pair of co-extensive outer frame members sandwiching therebetween an inner frame member having a smaller outer perimeter than the outer frame members to thus provide the groove.

In another aspect of the invention, larger loops than heretofore used have been employed. While it was previously thought that the maximum permissible loop circumference was approximately $\frac{1}{3}$ wavelength, the present invention may employ loops with a circumference or perimeter of $\frac{1}{2}$ wavelength, thus providing a larger loop aperture and enhanced performance. Rectangular loops have been found particularly well suited.

The above-noted loop construction is further particularly advantageous in combination with the above-noted cowling mounting arrangement and highly cost efficient.

In another aspect of the invention, the shield has one or more additional gaps each bridged by capacitance means which may be varied to change the electrical length of the shield, and provide enhanced fine tuning.

DETAILED DESCRIPTION

Figure 1:
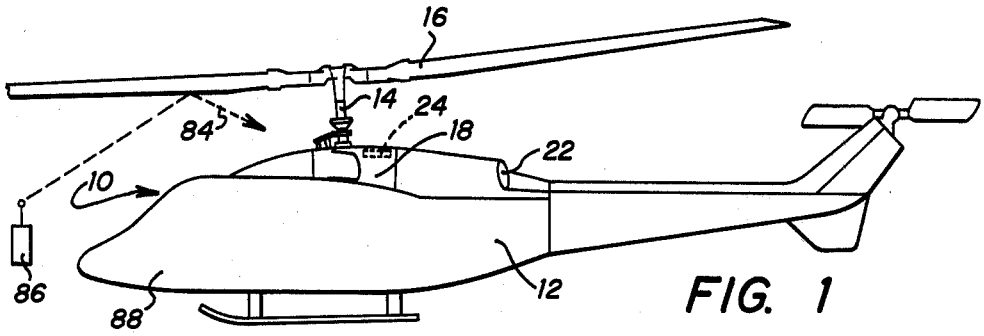
FIG. 1 is a side elevation view of a helicopter showing in dashed line the antenna system of the present invention mounted thereon.

There is shown in FIG. 1 a helicopter 10 having a longitudinal body 12 with a vertical mast 14 extending upwardly therefrom and supporting a rotor blade 16 having a horizontal rotary plane of motion. Referring to FIGS. 1–5, the helicopter has a pair of exterior cowling members 18 and 20 mounted to the helicopter on top of body 12 and laterally spaced on opposite sides thereof. The mast extends between these cowling members. Cowling member 18 is a one-piece integral unit having an outer shroud portion 18*a* with an air intake port 18*b* and an inner air-guide tube portion 18*c* extending rearwardly from the intake port. The air-guide tube portion communicates rearwardly with one of the helicopter engines (not shown) having an exhaust at 22. Cowling 20 is an identical mirror image of cowling 18.

Figure 2:
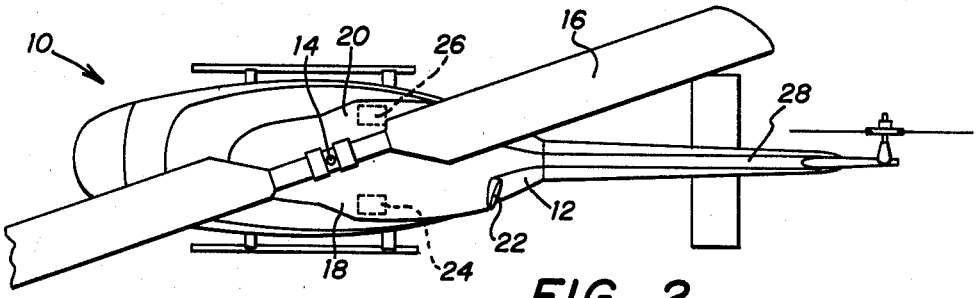
FIG. 2 is a top elevation view of the helicopter of FIG. 1.
Figure 3:
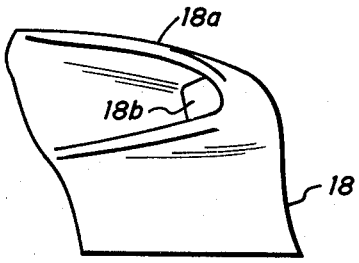
FIG. 3 is an isolated front isometric view of one of the pair of cowling members between which the helicopter mast extends and to which the pair of loop antennas are mounted.

A pair of rectangular loop antennas 24 and 26 are mounted to cowlings 18 and 20, respectively, in a generally horizontal plane and horizontally laterally spaced on opposite sides of the longitudinal center line 28, FIG. 2, of the helicopter body. Antenna 24 is mounted to the underside, FIGS. 4 and 5, of a top wall 18*d* of shroud portion 18*a*. Antenna 26 is identically mounted to cowling 20.

Figure 6:
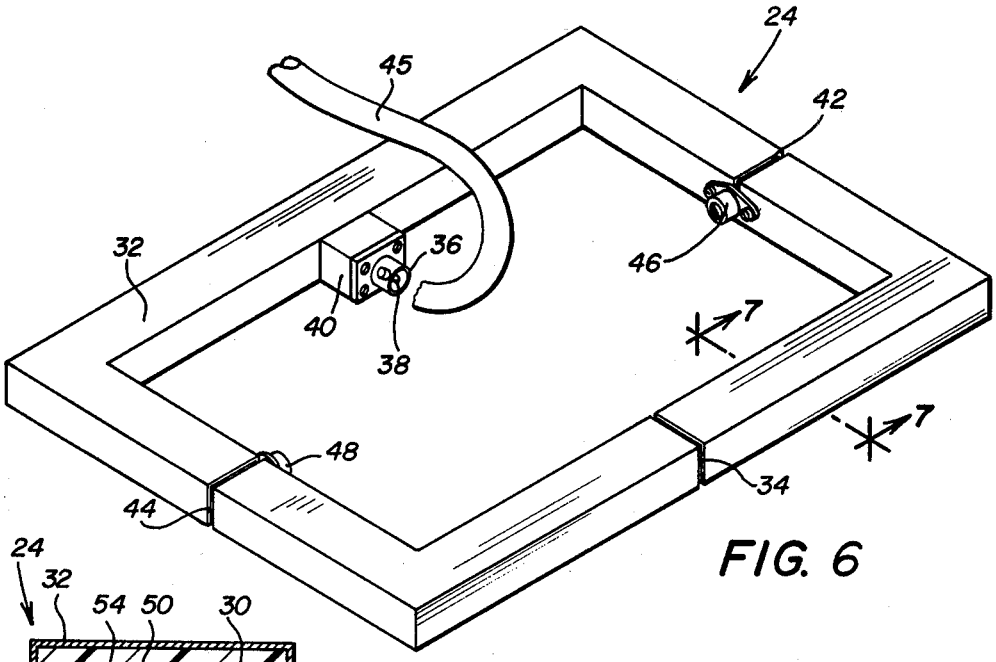
FIG. 6 is an isolated isometric view of a loop antenna constructed in accordance with the invention.
Figure 7:
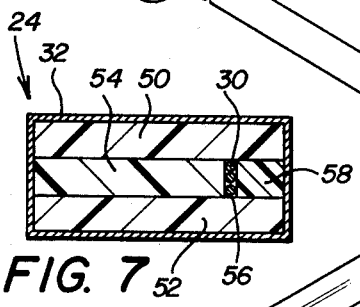
FIG. 7 is a cross sectional view taken along line 7—7 of FIG. 6.

Referring to FIG. 6, loop antenna 24 has one or more closed loop windings 30, FIG. 7, and a conductive shield 32 covering the windings and dielectrically separated therefrom. The shield has a small gap 34 breaking the continuity thereof to provide electrostatic shielding but to enable magnetic penetration to the windings 30. The antenna has communication means including a pair of electrical leads 36 and 38, which may be coaxial, extending through the shield from the windings at a connection point 40 opposite gap 34. The shield has additional gaps 42 and 44 which are bridged by capacitance means 46 and 48, respectively, which may be varied to change the electrical length of the shield, and provide enhanced fine tuning. High efficiency type capacitors have been found to afford the best results. Gaps 42 and 44 are spaced equally from and on opposite sides of connection point 40 for balancing purposes in preferred form. Antenna 26 is an identical mirror image of antenna 24. Coaxial cable 45 forms part of the communication means and is connectable to leads 36 and 38 and at the other end to the comparable connection leads from antenna 26 to connect the antennas in parallel co-phase.

Figure 8:
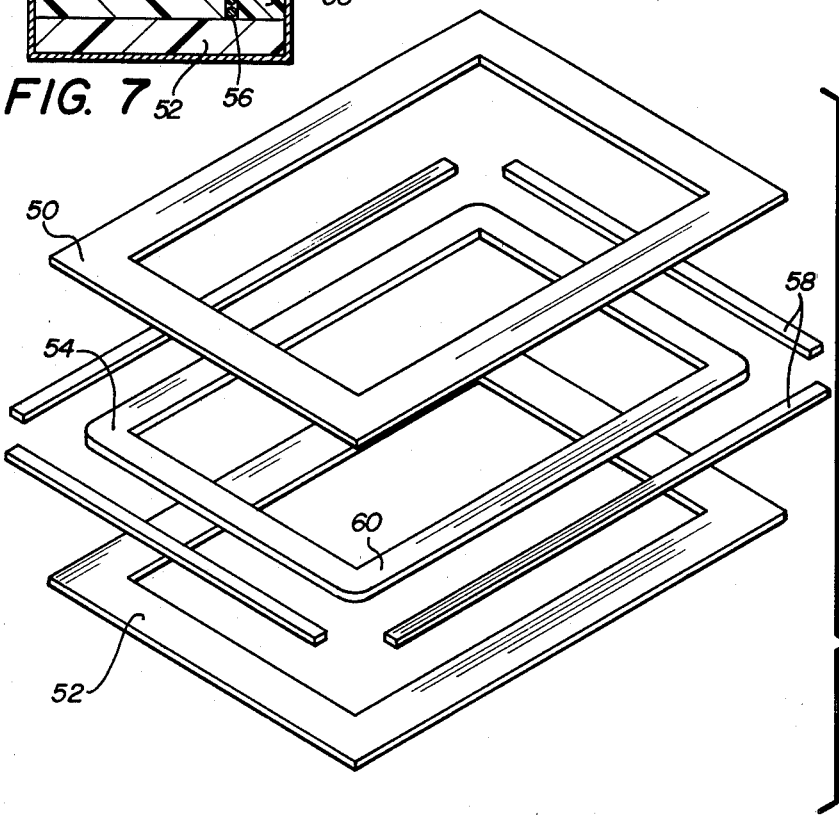
FIG. 8 is an exploded isometric view showing in preassembled condition some of the components of the antenna of FIG. 6.

In preferred form, antenna 24 includes a frame of a laminated structure of dielectric material comprising a pair of co-extensive outer frame members 50 and 52, FIGS. 7 and 8, sandwiching therebetween an inner frame member 54, all of dielectric material such as plastic. Polyethylene is used in the disclosed embodiment. The inner frame member 54 has the same inner perimeter as the outer frame members but a smaller outer perimeter to thus provide a groove 56 around the perimeter of the assembled structure upon lamination of the three frame members 50, 54 and 52. The antenna windings 30 are wound in a closed loop in this groove. Three such windings are shown in FIG. 7. The windings terminate at leads 36 and 38. After winding, the groove is closed by a dielectric filler material which also acts to hold the windings in place. Plastic strips 58 serve this purpose and snugly fit in groove 56 to ensure rigid securement of the windings. Outer corners 60 of inner frame member 54 are rounded to minimize acute antenna windings. Conductive shield 32 is a wrapped sheet-like member, though other alternatives such as electroplating may be used.

Figure 9:
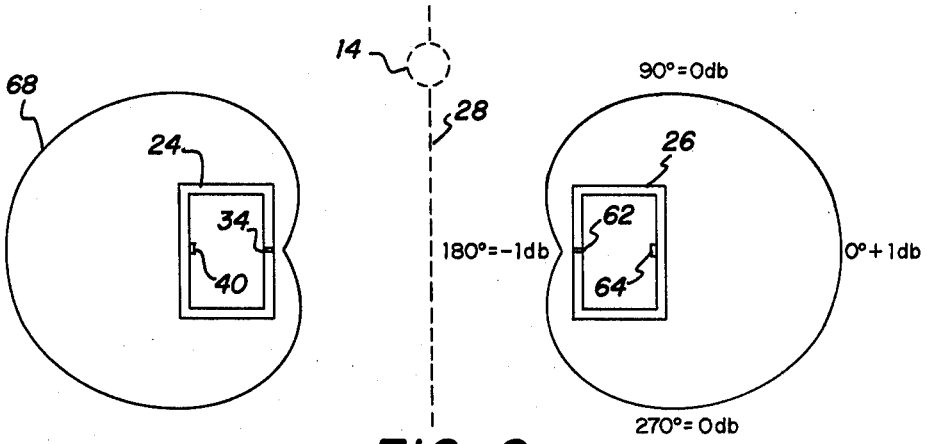
FIG. 9 is a schematic illustration of the individual radiation patterns for each antenna.
Figure 10:
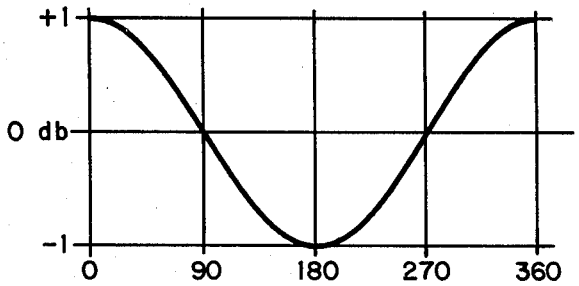
FIG. 10 shows typical values for the radiation pattern of either of the antennas of FIG. 9.

Referring to FIG. 9, antennas 24 and 26 are shown as in the top view orientatior of FIG. 2, but turned 90° to the right with the center line therebetween extending vertically. Gaps 34 and 62 in the conductive shields of antennas 24 and 26, respectively, are inboard relative to mast 14 and face each other on opposite sides of longitudinal center line 28 of the helicopter body. Connection points 40 and 64 are outboard and opposite the respective gaps. FIG. 9 shows the individual radiation pattern of each antenna in isolation as though the remaining antenna were not present. FIG. 10 shows the intensity values of the individual isolated cardioid radiation pattern of antenna 26. At 0° the intensity level is +1 decibel (db), at 90° it is 0 db, at 180° it drops to −1 db, and at 270° it is 0 db. Connection point 64 causes the lobe at 0°, yielding the increased intensity level thereat. The cardioid radiation pattern 66 of antenna 26 is identical to the cardioid radiation pattern 68 of antenna 24. An ideal loop antenna would have a substantially circular radiation pattern without the aforenoted lobes.

Figure 11:
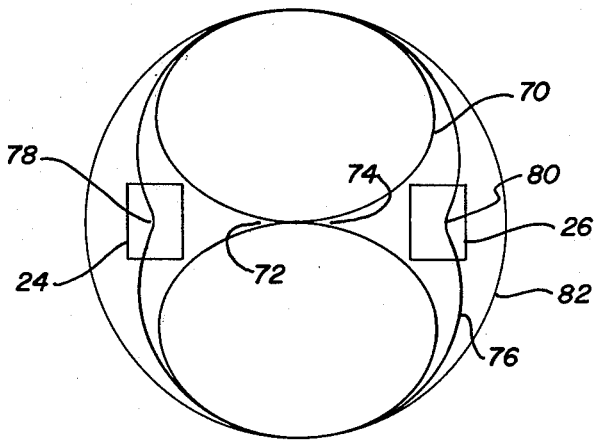
FIG. 11 is a schematic illustration of the composite radiation pattern of the pair of antennas and shows with curve 70 the composite radiation pattern of a pair of ideal loop antennas, and by curve 80 the isolated composite radiation pattern of the pair of antennas of the present invention, and by curve 82 the composite radiation pattern of the pair of loop antennas of the present invention in combination with the helicopter in the disclosed orientation therewith.

FIG. 11 shows antennas 24 and 26 in the orientation of FIG. 9. If these antennas were ideal loop antennas without the lobe effects of connection points 40 and 64, then the composite radiation pattern of the combination of these antennas so oriented would be that shown by curve 70 in the shape of a figure-eight. This curve has null points 72 and 74, and hence does not provide an omnidirectional radiation pattern. Curve 76 shows the composite radiation pattern of antennas 24 and 26 as constructed and oriented in accordance with the preferred embodiment of the present invention. The lobe effects of the individual cardioid radiation patterns of each antenna, FIG. 9, have substantially compensated null points 72 and 74 by raising the intensity levels in such direction to that schematically shown at points 78 and 80, to thus provide an omnidirectional pattern. Curve 82 shows the composite radiation pattern of antennas 24 and 26 when actually mounted on helicopter 10. It has been found that the helicopter body itself, particularly the mast structure and associated transmission mass and the like between the cowlings, interacts with the antenna system and further compensates the otherwise null points 72 and 74 even further beyond compensation points 78 and 80 to provide a substantially circular radiation pattern of substantially uniform intensity.

Actual readings taken during testing showed a −2.0 db level at points 72 and 74, a +3.5 db level at points 78 and 80, and a +4.5 db level along curve 82. There is thus a significant amplification factor over the individual radiation patterns. Furthermore this amplification is omnidirectional and uniform.

In the preferred disclosed VOR/ILS helicopter dual antenna system, the mounting and orientation of the pair of antennas is a significant aspect of the invention. Referring to FIG. 1, rotor modulation of the VOR/ILS signal was thought to be caused by optical type reflection 84 off the rotor blade from VOR/ILS signal source 86. This has been found not to be the case because in testing procedures on prior type antennas, the optical reflection path was eliminated, for example by disposing such prior type antenna on the underside of the helicopter as at 88, and the modulation problem still persisted. It is thus recognized that ground plane modulation by the rotor is the cause. This latter type modulation is eliminated in the present invention by shielded loops which do not suffer rotor induced impedance changes.

The most advantageous place to mount an antenna to the helicopter of the type shown is within the cowling because of ease of access thereto, as such cowlings are commonly detachable, and because such cowlings are usually made of material which is optically transparent at VOR/ILS frequency, such as fiberglass or nomax. A single antenna mounted thereat, however, will have a null spot in its radiation pattern on the other side of the helicopter body, and hence there will be dead spots when the transmitter 86 is on the wrong side. The preferred dual antenna system eliminates these dead spots and provides an omnidirectional radiation pattern regardless of which side of the helicopter body is disposed towards the transmitter.

Figure 4:
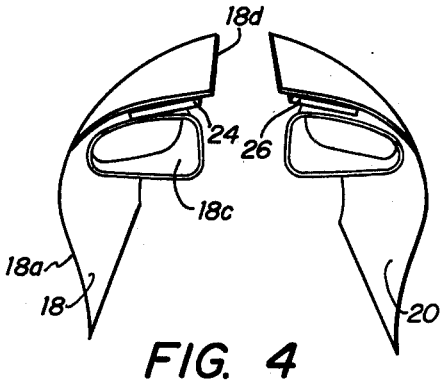
FIG. 4 is an isolated rear isometric view of the cowling members with the loop antennas mounted thereto.
Figure 5:
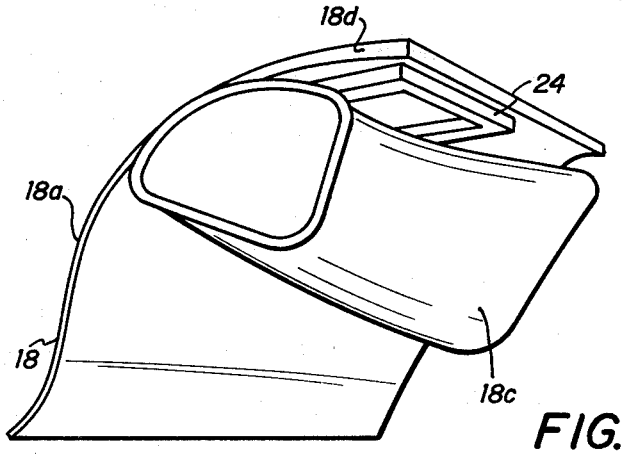
FIG. 5 is an enlarged isometric view of one of the cowling members and antennas showing more of the details thereof.

Furthermore, the preferred dual antenna embodiment enables the antennas to be mounted in convenient, accessible and protected spaces within the cowling members. These mounting spaces, as shown in FIGS. 4 and 5, are highly advantageous for a VOR/ILS reception capability because they are spaced laterally horizontally by slightly over four feet, which is ½ wavelength of the typical VOR/ILS frequency, 108–118 megahertz. The present invention recognizes and takes advantage of this highly desirable spacing and horizontal orientation for omnidirectional capability, notwithstanding the helicopter mast therebetween. Furthermore, the dual antennas actually function in cooperation with the helicopter mass therebetween to in fact provide in combination therewith enhanced, not degraded, performance.

A single antenna may be used provided the closed loop windings have a gapped conductive shield to prevent the impedance of the windings from being affected by rotor modulation, and provided the loop is mounted in a horizontal plane at a position receiving VOR/ILS signals without interposition of the aircraft between the antenna and the VOR/ILS signal source, for example position 88, FIG. 1. The preferred dual antenna system does not suffer this constraint and may be mounted on top of the aircraft as shown in FIG. 1. In either embodiment, rotor modulation of VOR/ILS signals is eliminated without varying rotor speed.

In preferred form, the antennas are 10 inch by 14 inch rectangles to thus have a perimeter of ½ wavelength and an aperture of 144 square inches. The 14 inch sides extend parallel to the longitudinal center line 28 of the helicopter. It was previously thought that the maximum permissible perimeter was ½ wavelength for VOR/ILS loops, and the operability of the presently used ½ wavelength perimeter was unexpected. The enhanced performance provided by the larger aperture thereof is of course welcome. Other loop antennas tested and found satisfactory were a 12 inch square antenna, and a circular antenna having a diameter of 8⅓ inches. Outboard connection points 40 and 64 are shown facing inwardly, however this inward facing is not a constraint of the invention, as the connection point may face upwardly, downwardly or outwardly. Inward facing is preferred because, as seen in FIG. 4, this will not interfere with remaining structure between the cowlings.

While a laminated frame comprising members 50, 54 and 52, FIGS. 7 and 8, is preferred, other alternatives are of course possible. For example, the frame may be injection or pour molded in one piece with a perimeteral groove comparable to groove 56, FIG. 7. Other alternatives include printed circuit board type loops, and even standard type loops comprised of a plurality of turns of wire disposed within a conductive tubular member.

It is recognized that various modifications are possible within the scope of the appended claims.

We claim:

1. A VOR/ILS antenna system for rotary wing aircraft eliminating modulation of signals without varying speed of a mast driven rotor, comprising:

a pair of loop antennas, each having one or more closed loop windings, mounted and spaced on said aircraft in a generally horizontal plane on opposite sides of said mast;

each said antenna having a conductive shield covering said windings and dielectrically separated therefrom, each said shield having a small gap breaking the continuity thereof and facing the gap in the other shield; and communication means including a pair of electrical leads for each said antenna extending through said shield from said windings at a point opposite said gap.

2. The invention according to claim 1 wherein at least one of said shields has at least one additional gap which is bridged by capacitance means which may be varied to change the electrical length of the shield.

3. The invention according to claim 2 wherein each said shield has two said additional gaps spaced equally from and on opposite sides of the connection point of said electrical leads to said windings, said additional gaps each bridged by capacitance means.

4. The invention according to claim 1 wherein said antennas are spaced apart approximately one-half wavelength of signal frequency approximately 108 to 118 megahertz.

5. The invention according to claim 4 wherein said antennas are connected in parallel co-phase by said communication means.

6. The invention according to claim 4 wherein the length of each said loop antenna along its perimeter is approximately one-half wavelength of said signal frequency.

7. A helicopter VOR/ILS antenna system for a helicopter having a longitudinal body with a vertical mast extending upwardly therefrom and supporting a rotor blade having a horizontal rotary plane of motion, comprising:

a pair of loop antennas, each having one or more closed loop windings, mounted and spaced on said helicopter in a generally horizontal plane on opposite sides of said mast;

each said antenna having a conductive shield covering said windings and dielectrically separated therefrom, each said shield having a small gap breaking the continuity thereof and facing the gap in the other shield; and communication means including a pair of electrical leads for each said antenna extending through said shield from said windings at a connection point opposite said gap.

8. The invention according to claim 7 wherein said loop antennas are laterally spaced on opposite sides of the longitudinal center line of said helicopter body, and wherein said connection point of said leads to said windings provides a lobe in the individual radiation pattern of the respective loop antenna which is outboard relative to said center line and which compensates an otherwise null point in the composite radiation pattern of the pair of said loop antennas, whereby to provide an omnidirectional composite radiation pattern.

9. The invention according to claim 8 wherein said otherwise null point is further compensated by the helicopter itself such that said antenna system in combination with said helicopter provides a substantially circular radiation pattern.

10. The invention according to claim 9 wherein said helicopter and said antenna system in combination provide substantially uniform composite amplification over the sum of the individual radiation patterns of said pair of antennas.

11. The invention according to claim 10 wherein the factor of said amplification is approximately two.

12. The invention according to claim 8 wherein said helicopter has a pair of exterior cowling members between which extends said mast, said cowling members being transparent to VOR/ILS frequency signals, said loop antennas being mounted within said cowling members.

13. The invention according to claim 12 wherein said cowling members are each a one-piece integral unit having an outer shroud portion with an air intake port and an inner air-guide tube portion extending from said intake port, and wherein said antenna is mounted to the underside of a top wall of a said shroud portion above said air-guide tube portion.

14. The invention according to claim 12 wherein said loop antennas are spaced apart within said cowlings approximately one-half wavelength of a signal frequency of approximately 108 to 118 megahertz.

15. The invention according to claim 14 wherein said loop antennas are rectangular and have an aperture of approximately 144 square inches.

16. The invention according to claim 8 wherein said loop antennas are spaced apart approximately one-half wavelength and connected by said communication means in parallel co-phase.

17. The invention according to claim 8 wherein at least one of said shields has at least one additional gap which is bridged by capacitance means which may be varied to change the electrical length of said shield.

18. The invention according to claim 17 wherein each said shield has two additional gaps spaced equally from and on opposite sides of said connection point, said additional gaps each bridged by capacitance means.

19. A helicopter VOR/ILS antenna system for a helicopter having a longitudinal body with a vertical mast extending upwardly therefrom and supporting a rotor blade having a horizontal rotary plane of motion, and a pair of exterior cowling members between which extends said mast, said cowling members being transparent to VOR/ILS frequency signals, comprising:

a pair of loop antennas each having one or more closed loop windings mounted in a horizontal plane within a respective one of said cowling members and spaced on opposite sides of said mast;

each said antenna having a conductive shield covering said windings and dielectrically separated therefrom, each said shield having a small gap breaking the continuity thereof and facing inboard relative to said mast;

communication means including a pair of electrical leads for each said antenna extending through said shield from said windings at a connection point opposite said gap and outboard relative to said mast;

each said connection point of said leads to said windings providing a lobe in the individual radiation pattern of the respective loop antenna which is outboard relative to said mast and which compensates an otherwise null point in the composite radiation pattern of the pair of said loop antennas whereby to provide an omnidirectional composite radiation pattern; and said helicopter itself further compensating said otherwise null point to provide in combination with said antenna system a substantially circular radiation pattern.

20. The invention according to claim 19 wherein said cowling members are each a one-piece integral unit having an outer shroud portion with an air intake port and an inner air-guide tube portion extending from said intake port, and wherein said antennas are rectangular members mounted to the underside of a top wall of said shroud portion in a gap above said air-guide tube portion, said antennas being spaced apart within said cowling members approximately one-half wavelength of a signal frequency of approximately 108 to 118 megahertz, and each antenna having an aperture of approximately 144 square inches and a perimeteral length of approximately said one-half wavelength, said communication means connecting said antennas in parallel cophase.

21. The invention according to claim 20 comprising a pair of rectangular laminated dielectric frame structures each comprising a pair of co-extensive outer frame members sandwiching therebetween an inner frame member having the same inner perimeter but a smaller outer perimeter than said outer frame members to thus provide a groove around the perimeter, said closed loop windings being situate in said groove, and said conductive shield comprising a sheet-like member wrapped around said laminated frame.

* * * * *